United States Patent [19]

Hamazawa et al.

[11] Patent Number: 4,574,262

[45] Date of Patent: Mar. 4, 1986

[54] LAMINATION-WOUND CHIP COIL AND METHOD FOR MANUFACTURING THE SAME

[75] Inventors: Yoshikazu Hamazawa, Yao; Tatsuro Hirai, Neyagawa; Tunenobu Horikoshi; Tomio Ishida, both of Hirakata, all of Japan

[73] Assignee: Matsushita Electric Industrial Co., Ltd., Osaka, Japan

[21] Appl. No.: 328,636

[22] Filed: Dec. 8, 1981

[30] Foreign Application Priority Data

Dec. 9, 1980 [JP] Japan ..... 55-177195[U]

[51] Int. Cl.[4] ..... H01F 15/10; H01F 17/04

[52] U.S. Cl. ..... 336/192; 336/200; 336/221

[58] Field of Search ..... 336/110, 192, 200, 221, 336/65

[56] References Cited

U.S. PATENT DOCUMENTS

| | | | |
|---|---|---|---|
| 2,874,360 | 2/1959 | Eisler . | |
| 3,333,334 | 8/1967 | Kuliczkowski et al. . | |
| 3,466,586 | 9/1969 | Bull et al. . | |
| 3,988,665 | 10/1976 | Neumaier et al. | 336/200 X |
| 4,056,800 | 11/1977 | Dionne et al. | 335/296 |
| 4,383,235 | 5/1983 | Layton et al. | 336/200 |
| 4,456,900 | 6/1984 | Toyoshima et al. | 336/100 X |

FOREIGN PATENT DOCUMENTS

| | | |
|---|---|---|
| 1534911 | 6/1968 | France . |
| 55-108717 | 7/1980 | Japan . |
| 1335472 | 10/1973 | United Kingdom . |

OTHER PUBLICATIONS

IBM Technical Disclosure Bulletin; vol. 15, No. 2, Jul. 1972, p. 363, O'Donnell, Jr., R. T.; "Flat Circuit Coil."

IBM Technical Disclosure Bulletin, vol. 16, No. 9, Feb. 1974, N. T. Gonnella et al., "Flexible Circuit Solenoid", p. 3008.

*Primary Examiner*—Reinhard J. Eisenzopf

*Attorney, Agent, or Firm*—Lowe, King, Price & Becker

[57] ABSTRACT

A lamination of a resilient and elongate magnetic sheet and a conductor strip is rolled up around a magnetic winding core to form a roll, and then the roll is sintered to produce an intermediate product. The conductor strip has both ends at both sides of the magnetic sheet so that both ends of the conductor strip are respectively exposed at both sides of the roll. Terminal electrodes are respectively attached to the both sides of the intermediate product to complete the chip coil. Another magnetic sheet may be provided to make the thickness of the lamination substantially uniform throughout the entire area. A second conductor strip may be provided in the lamination so that a coil having a tap can be actualized. The shrinkages of the winding core and the magnetic sheet are selected so that a desirable sintered product will result without suffering from delamination or cracks. The electrical characteristics of the coil may be changed by varying the amounts of components and changing additives in each of the materials respectively used for the winding core and the magnetic sheet.

8 Claims, 21 Drawing Figures

LAMINATION-WOUND CHIP COIL AND METHOD FOR MANUFACTURING THE SAME

BACKGROUND OF THE INVENTION

This invention relates generally to coils or inductors which are used in various electrical or electronic circuits, and particularly, the present invention relates to lamination-wound chip coils and method for manufacturing the same.

Most conventional coils, which are used in electrical or electronic circuits formed on a printed circuit board, have a magnetic core and a winding wound around the core. Both ends of the winding are respectively connected to lead wires which extend externally. However, such conventional coils have drawbacks in that it is troublesome and time-consuming to wind the winding, and it is bulky. Since it is preferred that various electrical and electronic parts and elements be small in size so as to fit in a limited space on a printed circuit board, it has been desired to develop a small coil chip. Furthermore, conventional coils required relatively long periods for mounting the same on a printed circuit board because the lead wires have to be bent, as facebonding techniques could not be applied.

Recently, a new type of coil has been developed as disclosed in Japanese Utility model Provisional Publication No. 55-108717. According to this new type of coil, a conductor strip is attached to one surface of an elongate magnetic sheet, and then the lamination of the magnetic sheet and the conductor strip is wound up to form a roll. The conductor strip is S-shaped or crank-shaped so that both ends of the strip will be exposed on both sides of the roll. Suitable metal terminals are then attached to both sides of the roll.

Although drawbacks inherent to the conventional coils can be solved by the above-mentioned new type coil, which may be called lamination-wound type coil, this lamination-wound coil has a drawback that the inductance range is relatively small because the inductance of the coil to be produced is defined by only the length of the conductor strip when the materials of the conductor strip and the magnetic sheet are not changed. Furthermore, the lamination-wound type coil disclosed in the above publication is apt to suffer from cracks which occur due to delamination or loose winding. In addition to these drawbacks, the lamination-wound coil is difficult to manufacture because it is difficult to tightly wind the lamination to form a roll.

SUMMARY OF THE INVENTION

The present invention has been provided in order to remove the above-mentioned various drawbacks inherent to the known lamination-wound type coil.

It is, therefore, an object of the present invention to provide a lamination-wound coil chip whose inductance can be freely set to a desired value throughout a wide range.

According to a feature of the present invention, the lamination can be readily wound so as to provide a tightly wound roll.

According to another feature of the present invention, the coil chip is free from cracks.

In accordance with the present invention there is provided a lamination-wound coil chip comprising: a winding core made of a magnetic substance; a roll of a lamination consisting of an elongate magnetic sheet and a conductive strip deposited on said magnetic sheet, said lamination being rolled up to center said winding core, said conductive strip having first and second ends which are respectively positioned at both sides of said magnetic sheet so that said first and second ends are exposed at both sides of the rolled up lamination; and first and second terminal electrodes respectively connected to both sides of said rolled up lamination.

In accordance with the present invention there is also provided a method of manufacturing a lamination-wound coil chip, comprising the steps of: forming an elongate lamination consisting of a magnetic sheet and a conductor strip deposited on said magnetic sheet, said conductive strip having first and second ends which are respectively positioned at both sides of said magnetic sheet; rolling up said lamination around a winding core made of a magnetic substance so that said first and second ends of said conductor strip are exposed at both sides of a rolled up lamination; sintering said rolled up lamination to provide an intermediate product; and attaching first and second terminal electrodes to the both sides of said intermediate product.

BRIEF DESCRIPTION OF THE DRAWINGS

The object and features of the present invention will become more readily apparent from the following detailed description of the preferred embodiments taken in conjunction with the accompanying drawings in which.

The same or corresponding elements and parts are designated at like numerals throughout the drawings.

DETAILED DESCRIPTION OF THE INVENTION

Prior to describing the preferred embodiments of the present invention, a conventional wire-wound coil will be discussed for a better understanding of the invention.

Figure 1:
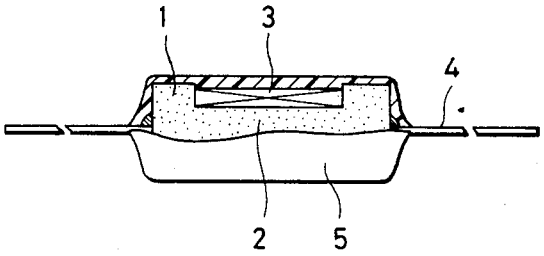
FIG. 1 PRIOR ART
FIG. 1 is a partial cross-sectional view of a conventional wire-wound coil chip.

FIG. 1 shows a conventional wire-wound coil of the axial type, and this coil is manufactured by winding a conductive wire around a magnetic core 2 made of ferrite or the like so as to form a winding 3 between flanges 1 at both ends of the core 2. Lead wires 4 are attached to both ends of the magnetic core 2, and are connected to both ends of the winding 3. Then resin coating is effected to form an exterior which covers the winding 3 and the core 2. As described above, the conventional coil of FIG. 1 is bulky, and it is time-consuming and troublesome to mount on a printed circuit board. Furthermore, it is time consuming to wind the wire 3.

Figure 2:
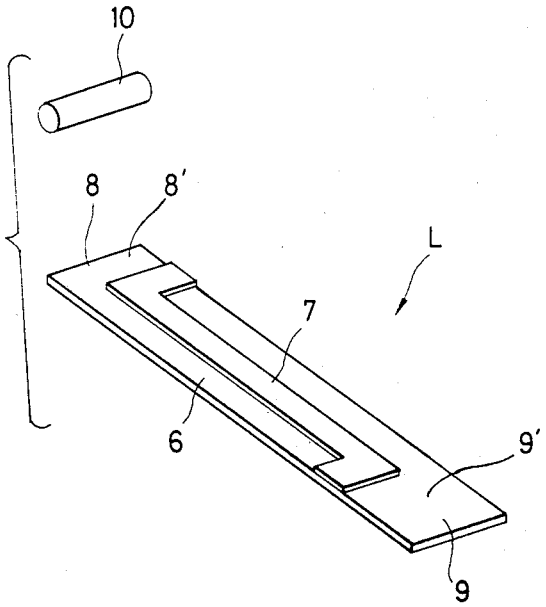
FIG. 2 is a schematic perspective view showing elements used in manufacturing a first embodiment of the coil chip according to the present invention.

Reference is now made to FIGS. 2 to 5 which show the manufacturing process of a first embodiment chip coil according to the present invention. Although a number of chip coils can be mass produced, it will be described in connection with a single chip coil for simplicity. FIG. 2 shows basic elements used for manufacturing the first embodiment chip coil. A generally S-shaped or crank-shaped conductive strip 7 is attached or placed on one surface of an elongate and resilient magnetic sheet 6. The conductive strip 7 may be formed on the magnetic sheet 6 by a suitable depositing technique, such as printing, vapor deposition or the like. The magnetic sheet 6 may be produced by either directly forming a large-size green sheet from a slurry of ceramics and a binder or forming such a large-size green sheet from the slurry on a suitable film made of polyester or the like. A repetitive pattern of the conductor strip 7 will be formed on one surface of the large-size magnetic sheet, and then the sheet will be cut into a plurality of pieces having a predetermined size. In the case of using the above-mentioned film, the film will be removed after cutting.

The combination of the elongate magnetic sheet 6 and the conductor strip 7 will be referred to as a lamination L hereinbelow. The elongate lamination L has a wind-starting end 8 and a wind-terminating end 9 at opposite end portions which are spaced by its longitudinal length. Both longitudinal edges of the elongate rectangular shape will be referred to as sides of the magnetic sheet 6. Although the conductor strip 7 is shown to provide margins 8′ and 9′ at the both ends 8 and 9 of the lamination L or the magnetic sheet 6, the margin 8′ may be omitted if desired. However, the opposite margin 9′ is necessary for constituting a closed magnetic path as will be described later.

Figure 3:
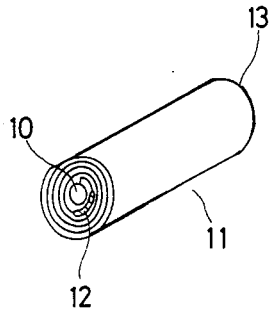
FIG. 3 is a schematic perspective view showing an intermediate product of the first embodiment coil chip.

The lamination L will be wound around a winding core 10 from the wind-starting end 8 with the conductor strip 7 being inside so as to form a roll 11 as shown in FIG. 3. Both ends 12 and 13 of the conductor strip 7 will be positioned and exposed at the both sides of the roll 11 as is shown. When winding the lamination L of FIG. 2 around the winding core 10, a suitable plasticizer may be painted at the wind-starting end 8 so that winding of the lamination L can be readily started.

Although the winding core 10 is shown to have a circular cross-section, the cross-section of the winding core may be of other shapes, for instance, elliptic shape or rectangular shape having rounded corners. Such a winding core 10 having a desired shape may be obtained by extrusion. According to the present invention, since the lamination L is wound or rolled up by using the winding core 10, the lamination L can be tightly wound compared to the case of such a winding core 10. Furtheremore, it is easy to wind the lamination L with the aid of the winding core 10 because the winding core 10 functions as a center support.

Figure 4:
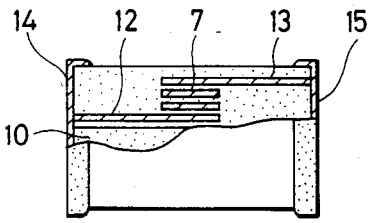
FIG. 4 is a schematic partial cross-sectional view of a finished product of the first embodiment coil chip.
Figure 5:
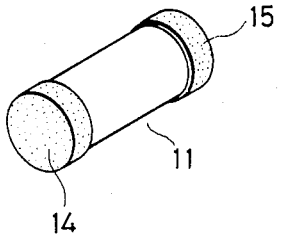
FIG. 5 is a schematic perspective view showing the first embodiment coil chip of FIG. 4.

The roll 11 of FIG. 3 is then sintered or baked, where the temperature is about 900 to 1000 degrees centigrade. As a result of the heat treatment, the wound lamination of the roll 11 shrinks so that the wound lamination is fixedly attached to the winding core 10. At this time, the wound magnetic sheet layers of the lamination L become integral as seen in a partial cross-sectional view of FIG. 4. With the above process, a chip coil proper of a sintered product is manufactured, and two terminal elctrodes 14 and 15 made of metal are then respectively attached, as shown in FIGS. 4 and 5, to both sides of the roll-shaped chip coil proper.

Figure 6:
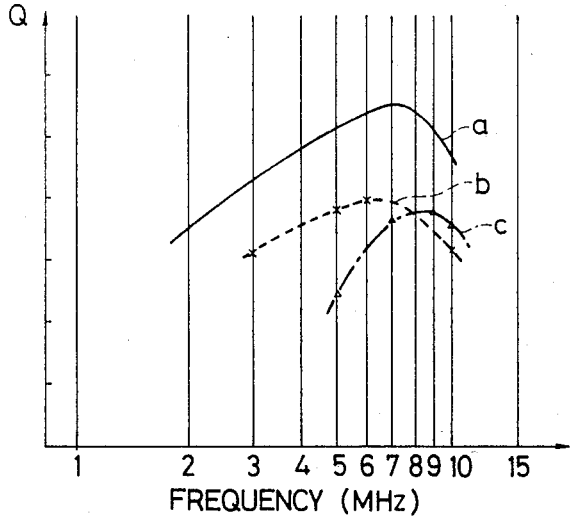
FIG. 6 is a graph showing electrical characteristics of the coil chips according to the present invention.

FIG. 6 is a graphical representation showing electrical characteristics of the lamination-wound chip coil according to the present invention. In the graph, the abscissa indicates frequencies and the ordinate indicates values of Q. The electrical characteristics of the coil may vary in accordance with the materials used for the magnetic sheet 6 and the winding core 10 while the size and shape of the elements are kept constant, and three examples are shown by three curves "a", "b" and "c". The curve "a" is obtained when a material A is used for the magnetic sheet 6, while a material B is used for the winding core 10 wherein materials A and B will be seen in the following table. The curve "b" is obtained when the material A is used for both the magnetic sheet 6 and the winding core 10. The curve "c" is obtained when the material B is used for both the magnetic sheet 6 and the winding core 10. The inductances of the coils respectively correspondinging to the curves "a", "b" and "c" are 8.7 μH, 7.3 μH, and 6.1 μH.

The components of the above-mentioned materials A and B are shown in the following table.

material A:

$Fe_2O_3$ . . . 50 mol %

NiO . . . 30 mol %

ZnO . . . 20 mol %

$V_2O_5$ is added by 0.3 wt % to the above components.

material B:

$Fe_2O_3$ . . . 50 mol %

NiO . . . 32 mol %

ZnO . . . 18 mol %

$MnO_2$ and CuO are respectively added by 0.1 wt % to the above components.

In order to provide the above-mentioned slurry, a suitable solvent and a binder will be added to the components of the above material A or B. As the binder, butyral resin or methylcellulose may be used.

From the above, it will be understood that the inductance range obtainable is much wider than that of the known lamination-wound coil having no winding core.

In addition, the value of Q can be set to a higher value than the known lamination-wound coil having no winding core. In detail, the inductance range can be widened by approximately 20 percent and Q can be improved by 30 to 40 percent when compared with the known lamination-wound coil having no winding core. Namely, the lamination-wound chip coil according to the present invention is superior in that a coil having a desired electrical characteristics can be readily provided.

Turning back to the above-described manufacturing process, the effect of contraction or shrinkage caused by the heat treatment will be described. Both the magnetic sheet 6 and the winding core 10 shrink during the sintering process, and the shrinkage of the magnetic sheet 6 is preferably set to a value which is a little greater than the shrinkage of the winding core 10 so that a sintered product having a high density will be obtained. Namely, by setting the shrinkage of the magnetic sheet 6 to a value which is greater than that of the winding core 10, winding-tightening pressure occurs in the roll 11 during the sintering process. Therefore, a sintered product having a high density can be obtained where there is no space between the magnetic sheet 6 and the winding core 10 and beween adjacent layers of the wound magnetic sheet 6.

If the difference in shrinkage between the magnetic sheet 6 and the winding core 10 is less than 3 percent, an adequate winding-tightening pressure does not occur during sintering process. As a result, delamination is apt to occur resulting in a low density sintered product. On the other hand, if the difference in shrinkage exceeds 10 percent, cracks or flaws are apt to occur during the sintering process. Accordingly, it is preferable to set the difference in shrinkage between the magnetic sheet 6 and the winding core 10 to a value which is between 3 and 10 percent. The shrinkage of each of magnetic sheet 6 and the winding core 10 may be readily changed by selecting the particle diameter of the magnetic substance, the sort and amount of the binder, the green sheet density etc.

As described in the above, according to the invention, since the materials for the magnetic sheet 6 and the winding core 10 can be selected separately or independently of each other, the shrinkage of each of the magnetic sheet 6 and the winding core 10 can be freely set to a desired value. Therefore, it is possible to improve the electrical characteristics of the coil compared to the aforementioned known lamination-wound coil in which only the magnetic sheet funtions as a magnetic core of the coil. According to the present invention not only the rolled up magnetic sheet 6 but also the winding core 10 function as the magnetic core of the coil. Furthermore, the lamination-wound coil according to the present invention is capable of providing a high inductance coil because of the closed magnetic path structure. The closed magnetic path structure is constructed of the winding core 10 positioned at the center of the roll-shaped coil and of a magnetic substance which surrounds the wound conductive strip 7, where the magnetic substance is actualized by a portion of the magnetic sheet 6, positioned at the outermost portion of the roll. Namely, the margin at the wind-terminating end 9 functions as the outermost magnetic substance when wound up. The terminal electrodes 14 and 15 attached to both sides of the intermediate product can be readily connected to the surface of a printed circuit board by facebonding.

Figure 7:
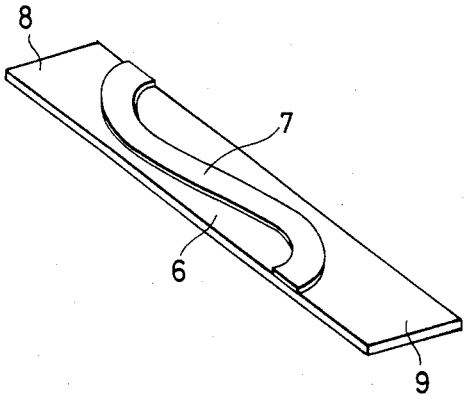
FIGS. 7 to 9 are schematic perspective views respectively showing modifications in the shape of the conductor strip used in the coil chip of FIGS. 2 to 5.
Figure 8:
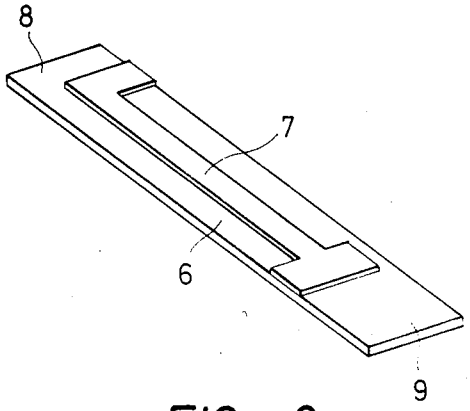
Figure 9:
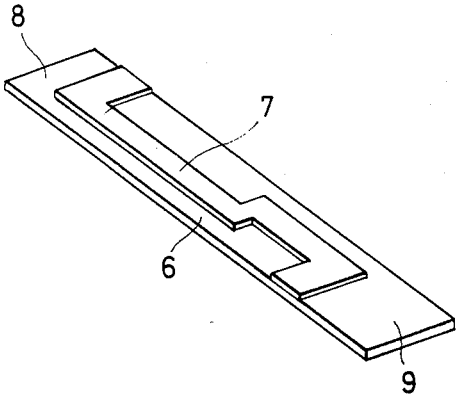

The shape of the conductor strip 7 attached to one surface of the magnetic sheet 6 may be changed. FIGS. 7 to 9 show various modifications in the shape of the conductor strip 7. It will be understood that the conductor strip 7 deposited on the magnetic sheet 6 has one end placed at one side of the elongate magnetic sheet 6 and the other end placed at the other side of the magnetic sheet 6. These ends of the conductor strip 7 are respectively positioned in the vicinity of the wind-starting end 8 and in the vicinity of the wind-terminating end 9. The conductor strip 7 between both ends thereof is positioned so that the conductor strip 7 is spaced from both sides of the magnetic sheet 6. Under these condition, the shape of the conductor strip 7 may be changed in various ways.

Figure 10:
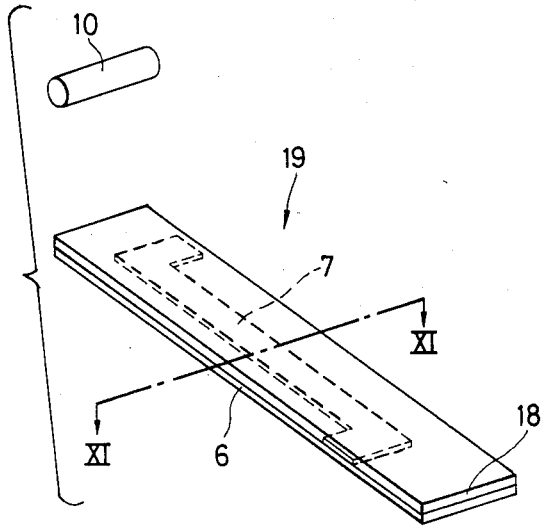
FIG. 10 is a schematic perspective view showing elements used in manufacturing a second embodiment of the coil chip according to the present invention.
Figure 11:
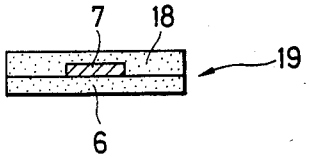
FIG. 11 is a cross sectional view of the lamination of FIG. 10, taken along the line XI—XI.

Reference is now made to FIGS. 10 and 11 which show a second embodiment of the present invention. The second embodiment differs from the above-described first embodiment in that another magnetic sheet 18 is deposited on the lamination L of FIG. 2 so as to cover the S-shaped conductor strip 7 of FIG. 2. Namely, the conductor strip 7 is interposed or sandwiched between two elongate magnetic sheets 6 and 18 as shown in the cross-sectional view of FIG. 11. The lamination of the two magnetic sheets 6 and 18 and the conductor strip 7 interposed therebetween may be referred to as a composite lamination 19. Since the upper magnetic sheet 18 is formed on the lower magnetic sheet 6 and the conductor strip 7, the conductor strip is sandwiched in such a manner that the conductor strip 7 is embedded in the upper magnetic sheet 18 as shown in FIG. 11. As a result, the composite lamination 19 has a substantially uniform thickness throughout its entire area.

Normally, the thickness of the magnetic sheets 6 and 18 is between 10 and 100 micrometers, while the thickness of the conductor strip 7 is selected so to as a value be between 2 and 20 micrometers depending on required characteristics. Generally speaking, when the thickness of the conductor strip 7 is over 7 micrometers, the first embodiment coil of FIGS. 2 to 5 is apt to suffer from the occurrence of delamination between adjacent layers of the wound lamination L. The second embodiment coil solves this problem by winding the composite lamination 19 having a substantially uniform thickness. From the above, it will be understood that the second embodiment of FIGS. 10 and 11 is preferable when the thickness of the conductor strip 7 exceeds approximately 7 micrometers. Although it has been described that the thickness of the composite lamination 19 of the second embodiment is uniform throughout its entire area, this does not mean that the thickness is perfectly uniform. For instance, if a 20 micrometers thick upper magnetic sheet 18 is deposited on a lamination L having a lower magnetic sheet 6 of 10 micrometers thick and a conductor strip 7 of 10 micrometers thick, the boss or protuberance in the upper magnetic sheet 18 occuring above the conductor strip 7 can be suppressed less than 3 to 5 micrometers. The upper magnetic sheet 18 may be formed directly by various methods from a slurry of ceramics and a binder, or may be formed by a printing techique.

The composite lamination 19 of FIGS. 10 and 11 will be rolled up centering the winding core 10 in the same manner as in the first embodiment and then sintering is effected to obtain an intermediate product. Then terminal electrodes will be attached to the both sides of the roll of the intermediate product to complete the coil.

Figure 12:
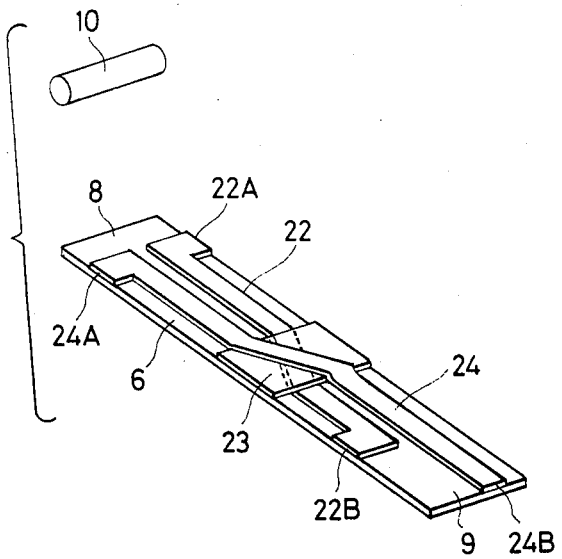
FIG. 12 is a schematic perspective view showing elements used in manufacturing a third embodiment of the coil chip according to the present invention.

A third embodiment of the present invention will be described with reference to FIGS. 12 to 21. As shown in FIG. 12, a first conductor strip 22, which corresponds to the conductor strip 7 of FIG. 2, is deposited on a magnetic sheet 6. The conductor strip 22 is generally S-shaped so that both ends thereof are respectively positioned at different sides of the elongate magnetic sheet 6. The deposition of the conductor strip 22 may be effected in the same manner as in the previous embodiments, while the magnetic sheet 6 is substantially the same as that of the first embodiment. The conductor strip 22 is different in shape from the conductor strip 7 of FIG. 2. Namely, the conductor strip 22 has a bent or curved portion at a portion around the middle thereof. On this bent portion is provided an insulating layer 23 made of a magnetic substance or the like by vapor deposition or printing. Then another conductor strip 24 is formed so that a portion thereof is placed on the insulating layer 23. The conductor strip 24 is generally L-shaped, and is positioned so that one end thereof is positioned at one side of the elongate magnetic sheet 6 in the vicinity of the wind-starting end 8, and the other end is positioned at the wind-terminating end 9. The conductor strip 24 also has a bent portion at the middle thereof so that the two conductor strips 22 and 24 are crossed at the insulating layer 23.

Then the lamination of the magnetic sheet 6 and the two conductor strips 22 and 24 is wound around the winding core 10 in the same manner as in the first embodiment. Namely, the lamination is rolled up from the wind-starting end 8 to the wind-terminating end 9 in such a manner that the side of conductors strips 22 and 24 is inside. Then a roll is formed as shown in FIG. 17.

Figure 13:
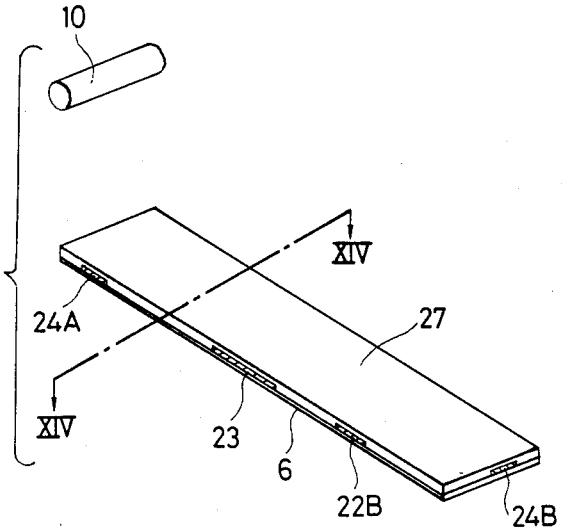
FIG. 13 is a schematic perspective view showing a modification of the embodiment of FIG. 12.
Figure 14:
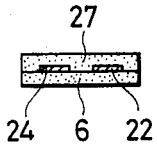
FIG. 14 is a cross-sectional view of the lamination of FIG. 13 taken along the line X IV—X IV.

Another magnetic sheet may be deposited on the upper suface of the lamination of FIG. 12 before winding in the same manner as in the second embodiment. FIGS. 13 and 14 show a modification of the embodiment of FIG. 12. In FIGS. 13 and 14, the reference numeral 27 indicates the above-mentioned other magnetic sheet which corresponds to the upper magnetic sheet 18 of FIGS. 10 and 11. FIG. 14 shows a cross-section taken along the line X IV—X IV in FIG. 13. The thickness of the composite lamination of FIGS. 13 and 14 is substantially uniform throughout its entire area because of the provision of the upper magnetic sheet 27.

Figure 15:
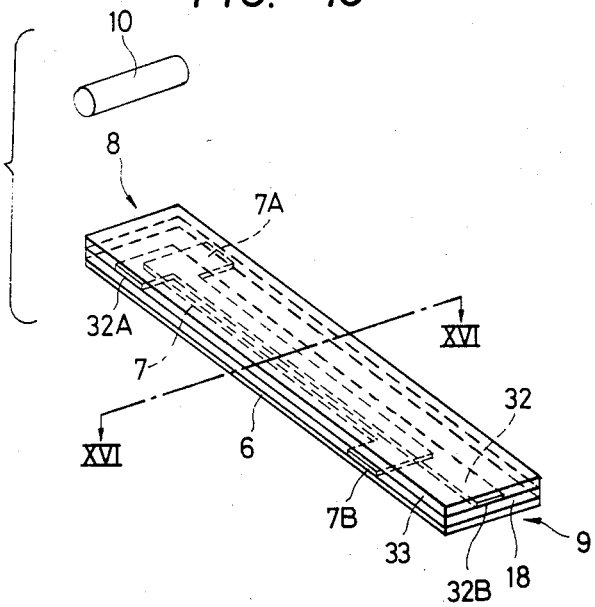
FIG. 15 is a schematic perspective view showing another modification of the third embodiment of FIG. 12.
Figure 16:
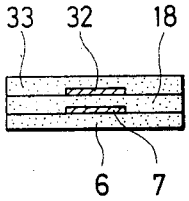
FIG. 16 is a cross-sectional view of the lamination of FIG. 15 taken along the line X VI—X VI.

Another modification of the third embodiment will be described with reference to FIGS. 15 and 16. As shown in FIG. 15, the same composite lamination 19 as in the second embodiment of FIGS. 10 and 11 is first produced, namely, the S-shaped conductor strip 7 is interposed between two magnetic sheets 6 and 18. Then a second conductor strip 32 is deposited on the composite lamination 19 where the second conductor strip 32 is L-shaped so that one end of the second conductor strip 32 is positioned at one side, which is opposite to the side that one end of the S-shaped conductor strip 7 is positioned, in the vicinity of the wind-starting end 8, and the other end thereof is positioned at the wind-terminating end 9. As shown in a cross-sectional view taken along the line X VI—X VI of FIG. 15, the second conductor strip 32 is located so that its straight middle portion faces the straight middle portion of the lower conductor strip 7. Although the composite lamination having two conductor strips 7 and 32 piled up may be wound as is, a third magnetic sheet 33 is shown to be further deposited on the second magnetic sheet 18 and the second conductor strip 32 so that the second conductor strip 32 is covered in a similar manner to the second embodiment. The second and third magnetic sheets 18 and 33 as well as the conductor strips 7 and 32 may be formed by printing or the like. A composite lamination produced in this way will be wound around the winding core 10 from the wind-starting end 8 toward the wind-terminating end 9 in the same manner as in the previous embodiments. Although the two conductor strips 7 and 32 are shown to be placed so that the upper conductor strip 32 is exactly superposed upon the lower conductor strip 7, the position of these conductor strips 7 and 32 may not necesarily be aligned, namely, the upper one 32 may be partially superposed upon the lower one 7 or the upper one 32 may not be superposed upon the lower one 7.

Figure 17:
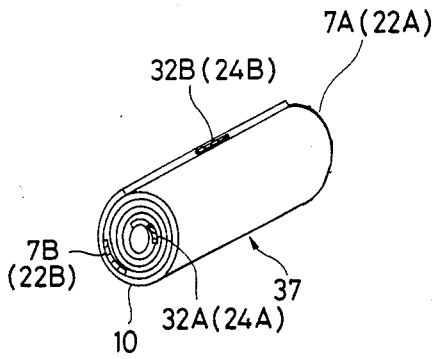
FIG. 17 is a perspective view of an intermediate product corresponding to the example of FIG. 12 or 13 and the example of FIG. 15.

As a result of winding or rolling up, a roll-like coil is produced and the roll is sintered to become an intermediate product as shown in FIG. 17 (FIG. 17 shows an intermediate product corresponding to both the examples of FIGS. 13 and 14 and FIGS. 15 and 16). The roll of FIG. 17 is generally designated at the reference 37, and comprises a first terminal 7A (22A) and a second terminal 7B (22B) which respectively correspond to the both ends 7A (22A) and 7B (22B) of the S-shaped lower conductor strip 7 (22), and third and fourth terminals 32A (24A) and 32B (24B) which respectively correspond to the both ends 32A (24A) and 32B (24B) of the L-shaped upper conductor strip 32 (24). All these four terminals are exposed outside the roll 37. As is shown, the first terminal 7A (22A) is positioned at one side of the roll 37; the second and third terminals 7B (22B) and 32A (24A) are positioned at the other side; and the fourth terminal 32B (24B) is positioned between the both sides, namely at a middle portion in the axial direction of the roll 37.

Figure 18:
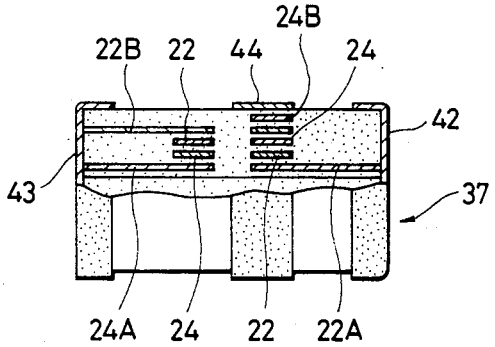
FIG. 18 is a partial cross sectional view of the intermediate product of FIG. 17 corresponding to the example of FIG. 12 or 13.
Figure 19:
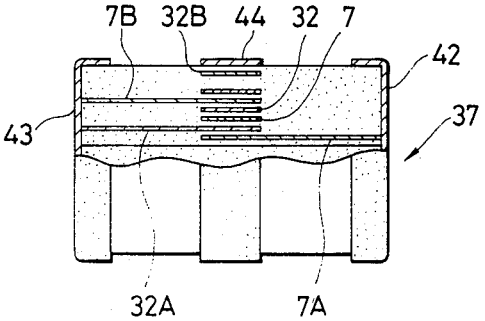
FIG. 19 is a partial cross sectional view of the intermediate product of FIG. 17 corresponding to the example of FIG. 15.
Figure 20:
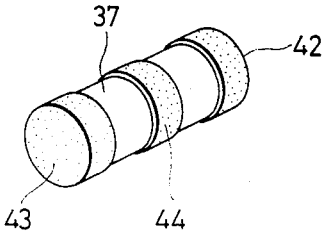
FIG. 20 is a schematic perspective view of a completed coil chip corresponding to the example of FIG. 18 or 19.
Figure 21:
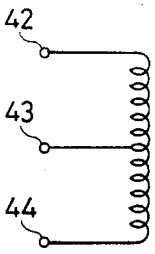
FIG. 21 is an equivalent circuit diagram of the coil of FIG. 20.

Terminal electrods are then attached to these terminals of the roll 37 as shown in FIGS. 18 to 20. FIG. 18 shows a partial cross-sectional view of a roll-like coil (finished product) corresponding to the example of FIGS. 12 or 13, while FIG. 19 shows a partial cross-sectional view of a roll-like coil (finished product) corresponding to the example of FIG. 15. FIG. 20 is a perspective view of the coil of FIG. 18 or 19. First and second terminal electrodes 42 and 43 are respectively attached to the both sides of the roll 37 as shown in FIGS. 18 and 19 in the same manner as in FIG. 5. In addition, a third terminal electrode 44 is attached to the periphery of the roll 37 so as to be in contact with the fourth terminal 32B (24B). Therefore, the second and third terminals 7B (22B) and 32A (24A) are electrically connected to each other via the second terminal electrode 43. Consequently, a coil having a tap has been actualized. FIG. 21 shows an equivalent circuit of the lamination-wound coil of FIG. 20.

The position of the tap corresponding to the second terminal electrode 43 may be changed by adjusting the length of the lower and upper conductor strips 7 (22) and 32 (24), and therefore, it is possible to provide various coils having a tap at different positions between its both ends.

From the foregoing description, it will be understood that a lamination-wound chip coil, which is free from delamination and has a closed magnetic path structure, can be readily obtained. And the coil according to the present invention may be readily mounted on a printed circuit board by facebonding, where each chip coil occupies a smaller space on the printed circuit board.

The above-described embodiments are just examples of the present invention, and therefore, it will be apparent for those skilled in the art that many modifications and variations may be made without departing from the spirit of the present invention.

What is claimed is:

1. A lamination-wound chip coil comprising:

(a) a winding core made of a first magnetic material having the capacity to shrink when subjected to sintering;

(b) a roll of laminate consisting of an elongated magnetic sheet and a conductive strip deposited on said magnetic sheet, said magnetic sheet comprising a second magnetic material having the capacity to shrink when subjected to sintering, said second magnetic material having a greater capacity to shrink than said first magnetic material, said laminate being rolled up around said winding core so as to place said winding core within the roll laminate, said roll laminate and winding core therein being sintered together forming an integral sintered body, said sintered magnetic sheet being shrunk to a greater extent than said sintered winding core, whereby, a winding tightening pressure occurs between said roll laminate and said winding core, said conductive strip having first and second ends which are respectively positioned at both sides of said magnetic sheet so that said first and second ends are exposed at both sides of the rolled up laminate, and together with said winding core forming an integral sintered body; and (c) first and second terminal electrodes respectively connected to the both sides of said sintered body at said first and second ends of said conductive strip.

2. A lamination-wound chip coil as claimed in claim 1, wherein said conductor strip is generally S-shaped when said lamination is developed into a plane so that said conductor strip is exposed at both its ends to be in contact with said first and second terminal electrodes respectively, said conductor strip being positioned on said magnetic sheet so that said magnetic sheet has a margin at its wind-terminating end.

3. A lamination-wound chip coil as claimed in claim 1, further comprising a second magnetic sheet constituting said lamination, said conductor strip being interposed between the first mentioned magnetic sheet and said second magnetic sheet.

4. A lamination-wound chip coil as claimed in claim 1, further comprising a second conductor strip constituting said lamination, said second conductor strip being deposited on said magnetic sheet, said second conductor strip being L-shaped when developed into a plane so that one end thereof is placed at one side of said rolled up lamination and the other end thereof is exposed at a portion between said both sides of said rolled up lamination, said second conductor strip crossing the first mentioned conductor strip; an insulating layer interposed between said two conductor strips where said second conductor strip crosses said first conductor strip; and a third terminal electrode attached to the periphery of said rolled up lamination so as to be in contact with said other end of said second conductor strip.

5. A lamination-wound chip coil as claimed in claim 4, further comprising a second magnetic sheet constituting said lamination, said first and second conductor strips being interposed between the first mentioned magnetic sheet and said second magnetic sheet.

6. A lamination-wound chip coil as claimed in claim 3, further comprising a second conductive strip constituting said lamination, said second conductor strip being generally L-shaped when developed into a plane so that one end thereof is placed at one side of said rolled up lamination and the other end thereof is exposed at a portion between said both sides of said rolled up lamination, said second conductor strip crossing the first mentioned conductor strip; and a third terminal electrode attached to the periphery of said rolled up lamination so as to be in contact with said other end of said second conductor strip.

7. A lamination-wound chip coil as claimed in claim 6, further comprising a third magnetic sheet constituting said lamination, said second magnetic sheet and said first and second conductor strips being interposed between said first and third magnetic sheets.

8. A lamination-wound chip coil as claimed in claim 1, wherein the materials of said winding core and said magnetic sheet are selected so that the shrinkage of said magnetic sheet during sintering is greater than that of said winding core by 3 to 10 percent.

* * * * *